US009138117B2

(12) United States Patent
Yun et al.

(10) Patent No.: US 9,138,117 B2
(45) Date of Patent: Sep. 22, 2015

(54) CLEANING APPARATUS

(75) Inventors: Min Ro Yun, Gwang-ju (KR); Byung Jo Lee, Gwang-ju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 484 days.

(21) Appl. No.: 13/539,893

(22) Filed: Jul. 2, 2012

(65) Prior Publication Data

US 2013/0008469 A1 Jan. 10, 2013

(30) Foreign Application Priority Data

Jul. 4, 2011 (KR) ..... 10-2011-0066164
Apr. 6, 2012 (KR) ..... 10-2012-0035958

(51) Int. Cl.
*A47L 5/34* (2006.01)
*A47L 9/04* (2006.01)

(52) U.S. Cl.
CPC ..... *A47L 9/0494* (2013.01)

(58) Field of Classification Search
CPC ..... A47L 5/34; A47L 9/0494; A47L 9/009
USPC ..... 15/339, 354
IPC ..... A47L 5/34
See application file for complete search history.

(56) References Cited

U.S. PATENT DOCUMENTS 7,316,051 B2 * 1/2008 Budd ..... 15/361
2006/0021184 A1 * 2/2006 Hawkins et al. ..... 15/377

* cited by examiner

*Primary Examiner* — David Redding
(74) *Attorney, Agent, or Firm* — Staas & Halsey LLP

(57) ABSTRACT

A cleaning apparatus including a brush to sweep up dust on the floor via rotation thereof, and an elevating device to vertically adjust a height of the brush. The elevating device includes an elevating motor to generate rotation force, a cam configured to be rotated by the elevating motor and serving to vertically move the brush, and a rotation switch configured to rotate in a given direction along with the cam and serving to sense a position of the brush. The cleaning apparatus is structurally simplified as a resulting of using an Alternating Current (AC) motor as the elevating motor.

15 Claims, 8 Drawing Sheets

CLEANING APPARATUS

CROSS-REFERENCE TO RELATED APPLICATIONS

This application claims the priority benefit of Korean Patent Applications No. 10-2011-0066164, filed on Jul. 04, 2011 and No. 10-2012-0035958, filed on Apr. 06, 2012 in the Korean Intellectual Property Office, the disclosure of both of which is incorporated herein by reference.

BACKGROUND

1. Field

Example embodiments of the following disclosure relate to a cleaning apparatus having an elevating device to adjust the height of a brush.

2. Description of the Related Art

Generally, cleaning apparatuses are used to clean the floor of a room by removing contaminants from the floor. For example, vacuum cleaning apparatuses are widely used in homes.

These cleaning apparatuses include a brush to sweep up contaminants that are on the floor via rotation thereof. It may be advantageous for the brush to come into close contact with a floor if the floor is smooth. However, in the case of cleaning, for example, a carpet, spacing the brush apart from the floor by a predetermined distance may be necessary to keep the brush from directly touching fibers of the carpet. To this end, the cleaning apparatuses include an elevating device to adjust the height of the brush based on the state of the floor.

SUMMARY

Therefore, it is an aspect of the present invention to provide a cleaning apparatus which functions to adjust the height of a brush via an elevating motor that is rotated in a given direction.

Additional aspects of the invention will be set forth in part in the description which follows and, in part, will be obvious from the description, or may be learned by practice of the invention.

In accordance with one aspect of the present invention, a cleaning apparatus includes a brush to sweep up dust on the floor via rotation thereof, and an elevating device to vertically adjust a height of the brush, wherein the elevating device includes an elevating motor in the form of an Alternating Current (AC) motor to generate rotation force only in a given direction, a cam configured to be rotated by the elevating motor and serving to vertically move the brush, and a rotation switch configured to be rotated by the cam and serving to sense a position of the brush, and wherein the rotation switch includes a connecting shaft connected to the cam, and a variable resistor configured to be rotated by the connecting shaft to vary output voltage based on a rotation angle thereof.

The variable resistor may have a circular annular shape to perform endless rotation only in a given direction without limitation.

The variable resistor may have a resistance that varies stepwise based on the rotation angle of the rotation switch.

The cam may have a circumferential cam surface, a height of which circumferentially varies stepwise.

The stepwise height of the cam surface may be repeated at least twice.

The cleaning apparatus may further include a display unit to display the height of the brush.

The display unit may include a plurality of light emitting diodes, and a display substrate on which the plurality of light emitting diodes is placed.

In accordance with another aspect of the present invention, a cleaning apparatus includes an upright main body, a suction unit placed at a lower end of the main body and provided at a front end thereof with a brush, a pair of wheels mounted to opposite sides of a rear end of the suction unit, a pair of auxiliary wheels mounted to opposite sides of the bottom of the suction unit, and an elevating device mounted to the suction unit to vertically adjust a height of the brush, wherein the elevating device includes an elevating motor in the form of an AC motor to generate rotation force only in a given direction, a cam configured to be rotated by the elevating motor and serving to vertically move the brush, and a rotation switch configured to be rotated by the cam and serving to sense the height of the brush.

In accordance with a further aspect of the present invention, a control method of a cleaning apparatus, includes inputting, by a user, a height of the brush via a button, rotating a cam and a rotation switch via an elevating motor until output voltage of a variable resistor of the rotation switch coincides with a preset voltage of the controller corresponding to the input height of the brush, and stopping the elevating motor when the output voltage of the variable resistor coincides with the preset voltage of the controller.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
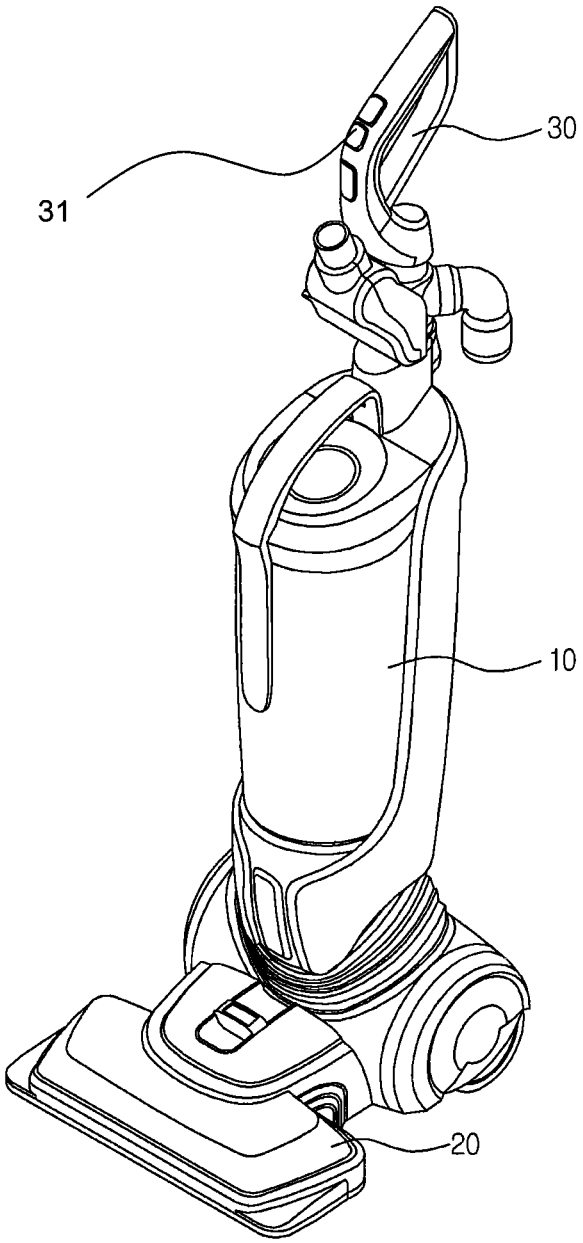
FIG. 1 is a perspective view of a cleaning apparatus, according to an example embodiment of the present disclosure.

Reference will now be made in detail to a cleaning apparatus according to the embodiment of the present invention, examples of which are illustrated in the accompanying drawings, wherein like reference numerals refer to like elements throughout.

As shown in FIG. 1, the cleaning apparatus according to an example embodiment of the present invention includes an upright main body 10, a suction unit 20 mounted to a front lower position of the main body 10 to suction contaminants from the floor of a room, and a handle 30 coupled to the top of the main body 10 to assist a user in easily maneuvering or moving the cleaning apparatus.

Although not clearly shown in the drawings, the main body 10 may contain a blower that generates a suction force to suction contaminants, such as dust, from the floor through the suction unit 20, and a dust collector that collects and stores the contaminants suctioned through the suction unit 20. The handle 30 is provided with a plurality of buttons 31 that allow the user to select between various operations of the cleaning apparatus. For example, one of the buttons 31 is a height adjusting button that will hereinafter be described, and the user may adjust the height of a brush 21 via the height adjusting button.

Figure 2:
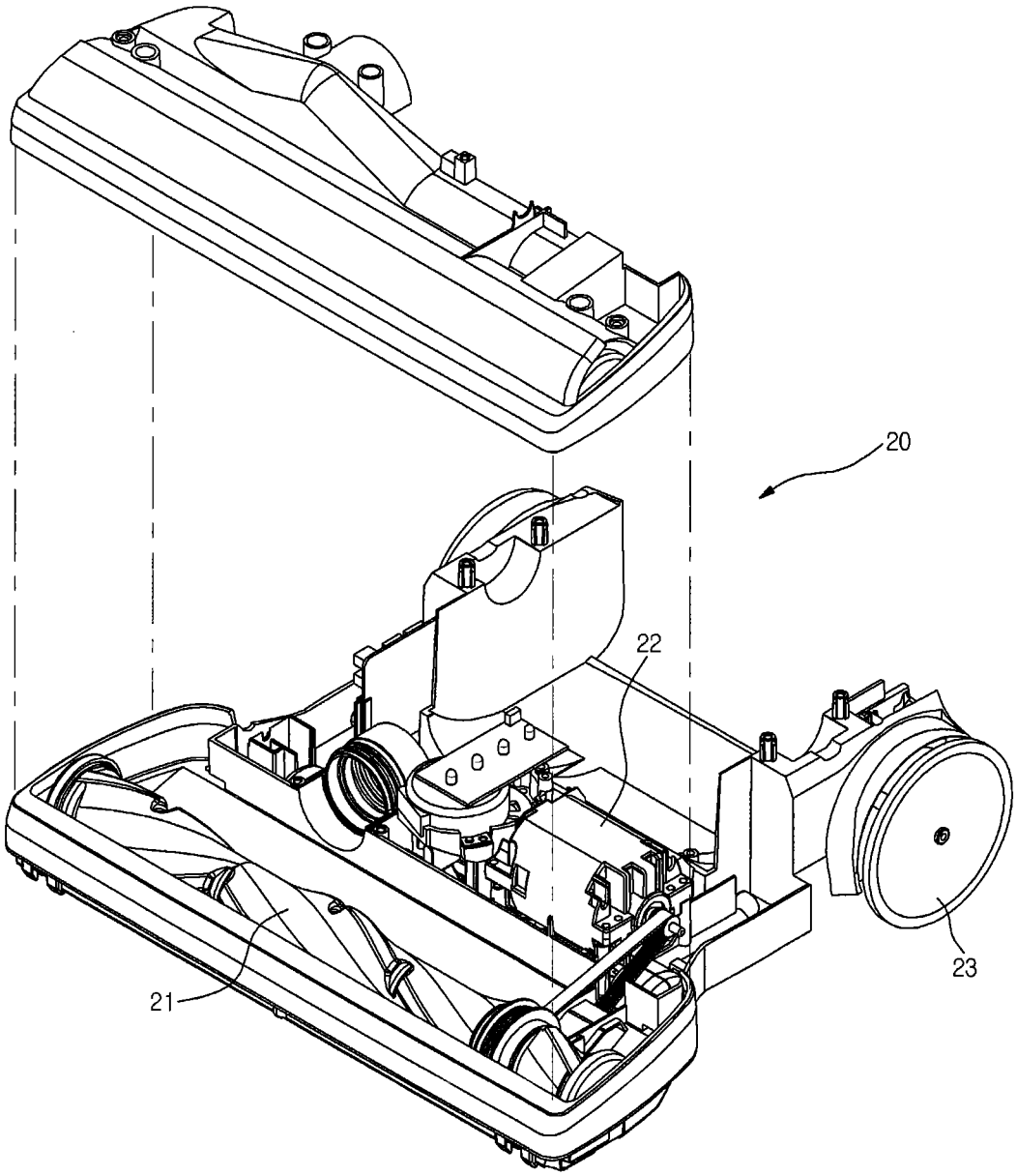
FIG. 2 is a perspective view showing an elevating device of the cleaning apparatus, according to an example embodiment.
Figure 3:
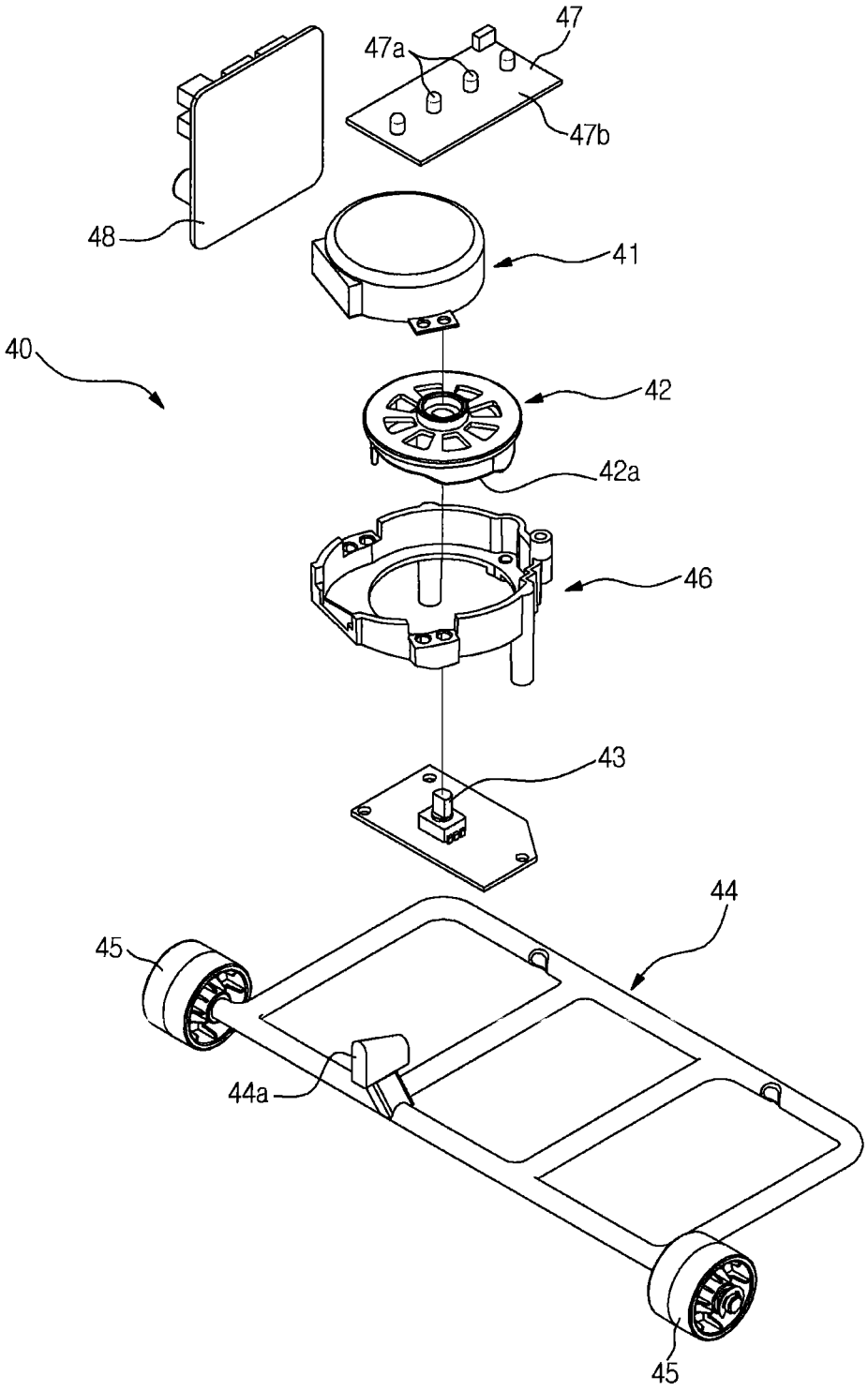
FIG. 3 is an exploded perspective view showing the elevating device of the cleaning apparatus, according to an example embodiment.

As shown in FIG. 2, a pair of wheels 23 is provided at opposite sides of a rear end of the suction unit 20 to enable movement of the cleaning apparatus on the floor. The brush 21 is rotatably mounted within the suction unit 20 at a front end thereof to sweep up dust on the floor so as to assist easy dust suction through the suction unit 20. Also, a brush drive motor 22 is placed within the suction unit 20 to rotate the brush 21. In the present embodiment, the brush 21 is rotated upon receiving rotation force of the drive motor 22 via a belt. As shown in FIG. 3, two auxiliary wheels 45 are additionally arranged at opposite sides of the bottom of the suction unit 20. In this way, the cleaning apparatus may perform cleaning of the floor by easily moving on the floor using the two wheels 23 and the two auxiliary wheels 45.

The cleaning apparatus further includes an elevating device 40 to vertically adjust the height of the brush 21. In the present embodiment, the elevating device 40 is placed in the suction unit 20, however, the present disclosure is not limited thereto. The elevating device 40 vertically adjusts the height of the brush 21 placed at the front end of the suction unit 20 by allowing the suction unit 20 to rotate about the wheels 23 placed at the rear end thereof.

The elevating device 40, as shown in FIG. 3, includes an elevating motor 41 to generate a rotation force, a cam 42 that rotates upon receiving the rotation force of the elevating motor 41 through a shaft (41*a*, FIG. 6) of the elevating motor 41, an elevating guide 44 to guide vertical movement of the brush 21 via interaction with the cam 42, and a rotation switch 43 to sense the height of the brush 21 while rotating along with the cam 42.

The cam 42 is circumferentially provided at a lower surface thereof with a cam surface 42*a*. The cam surface 42*a* circumferentially extends and has a height that varies in multiple stages so as to vertically move the brush 21 in multiple stages in a stepwise manner. In the present embodiment, the multistage cam surface 42*a* circumferentially extends and the circumferentially extended portion increases in height in a stepwise manner, thereby acting to vertically move the height of the brush 21 stepwise via rotation of the cam 42. More particularly, in the present embodiment, the multistage cam surface 42*a* may sequentially raise the height of the brush 21 from the first stage to the fourth stage, and the stepwise height of the cam surface 42*a* may be repeated twice. In this way, whenever the cam 42 rotates once, the height of the brush 21 may vary twice in sequence from the first stage to the fourth stage.

Figure 4:
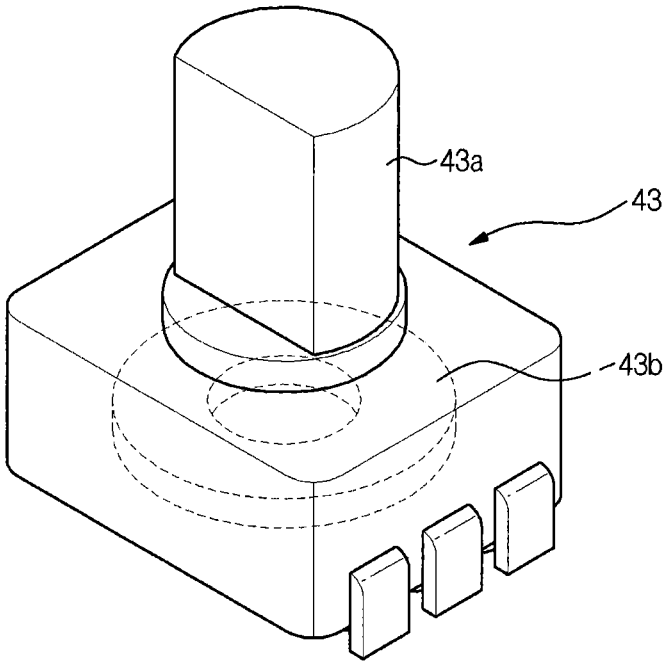
FIG. 4 is a perspective view showing a rotation switch employed in the cleaning apparatus, according to an example embodiment.

The rotation switch 43, as shown in FIG. 4, includes a connecting shaft 43*a* connected to the cam 42 to rotate upon receiving rotation force from the cam 42, and a variable resistor 43*b* configured to rotate along with the connecting shaft 43*a*. In the present embodiment, the variable resistor 43*b* has a circular annular shape to endlessly rotate in a given direction, and has a resistance that varies stepwise in a circumferential direction. Thus, the variable resistor 43*b* rotates along with the connecting shaft 43*a*, and outputs voltage that varies stepwise based on a rotation angle thereof.

Accordingly, when the variable resistor 43*b* rotates upon receiving rotation force from the cam 42 via the connecting shaft 43*a* of the rotation switch 43, output voltage of the variable resistor 43*b* varies stepwise based on rotation of the variable resistor 43*b*. Thus, a rotation angle of the cam 42 may be sensed based on the output voltage, and consequently the height of the brush 21 may be confirmed based on the rotation angle of the cam 42.

As described above, since the cam surface 42*a* provided at the cam 42 is a circumferential multistage surface, the stepwise height of which is repeated, and the variable resistor 43*b* is endlessly rotatable in a given direction, the elevating motor 41 may be an Alternating Current (AC) motor that generates rotation force only in a given direction. This is because, in the case of the above-described configuration, sequential variation of the height of the brush 21 may be realized even through use of the AC motor that is rotatable only in a given direction. The AC motor does not need any additional elements, such as, a rectifier circuit, and thus, may contribute to structural simplification of the cleaning apparatus. In the present embodiment, the elevating motor 41 is fixedly mounted within the suction unit 20 via a fixing bracket 46.

Referring again to FIG. 2, the elevating guide 44 has a rear end rotatably coupled to the bottom surface of the suction unit 20 and a front end, to which the above-described auxiliary wheels 45 are rotatably mounted at opposite sides. The elevating guide 44 is provided with a guide piece 44*a* to interact with the cam surface 42*a* formed at the lower surface of the cam 42. The guide piece 44*a* integrally extends upward from the center of the front end of the elevating guide 44, such that an upper end thereof is supported by the cam surface 42*a*.

The elevating device 40 further includes a display unit 47 to allow the user to visually confirm the height of the brush 21, and a board assembly 48 to control operation of the elevating device 40 by measuring the output voltage of the rotation switch 43. The display unit 47 includes a plurality of light emitting diodes 47*a*, and a display substrate 47*b* on which the plurality of light emitting diodes 47*a* is placed.

Figure 5:
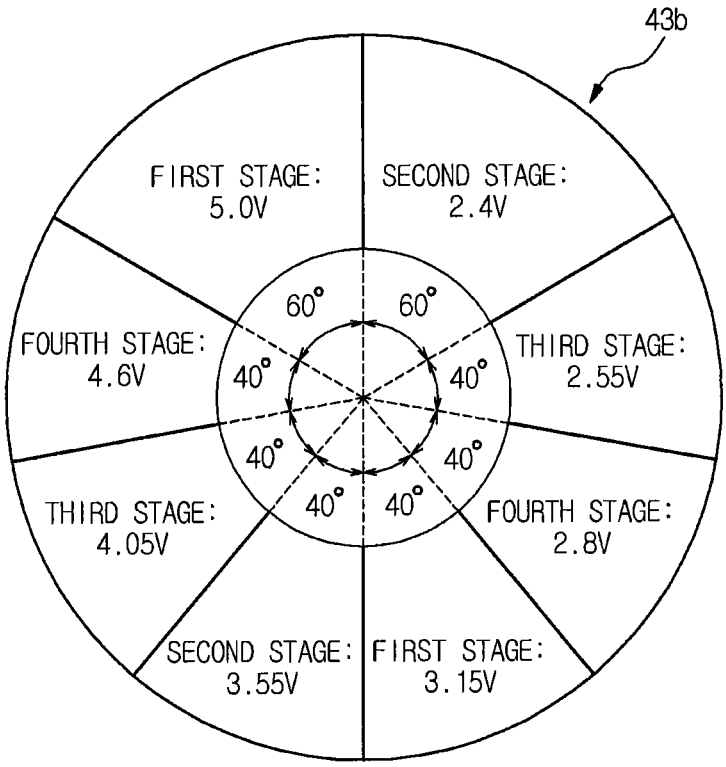
FIG. 5 is a view showing output voltage depending on the rotation angle of a variable resistor employed in the cleaning apparatus, according to an example embodiment.

FIG. 5 is a view showing output voltages of the variable resistor 47*b* based on rotation angles of the variable resistor 43*b* when voltage of 5V is input to the variable resistor 43*b* of the rotation switch 43.

As shown, the rotation switch 43 directly outputs the input voltage of 5V when the rotation angle is in a range of 300°~0° in which the height of the brush 21 is at the first stage, outputs voltage of 2.4V when the rotation angle is in a range of 0°~60° in which the height of the brush 21 is at the second stage, outputs voltage of 2.55V when the rotation angle is in a range of 60°~100° in which the height of the brush 21 is at the third stage, and outputs voltage of 2.8V when the rotation angle is in a range of 100°~140° in which the height of the brush 21 is at the fourth stage. In succession, the rotation switch 43 outputs voltage of 3.15V when the rotation angle is in a range of 140°~180° in which the height of the brush 21 is at the first stage, outputs voltage of 3.55V when the rotation angle is in a range of 180°~220° in which the height of the brush 21 is at the second stage, outputs voltage of 4.05V when the rotation angle is in a range of 220°~260° in which the height of the brush 21 is at the third stage, and outputs voltage of 4.6V when the rotation angle is in a range of 260°~300° in which the height of the brush 21 is at the fourth stage. In this way, it may be possible to confirm at which one of the first stage to the fourth stage the brush 21 is located via the output voltage of the rotation switch 43.

In the above description, since the angle and input/output voltages are given by way of example, the angle may be changed based on the shape of the cam 42, and the voltage used may be changed based on a designer's need.

Figure 6:
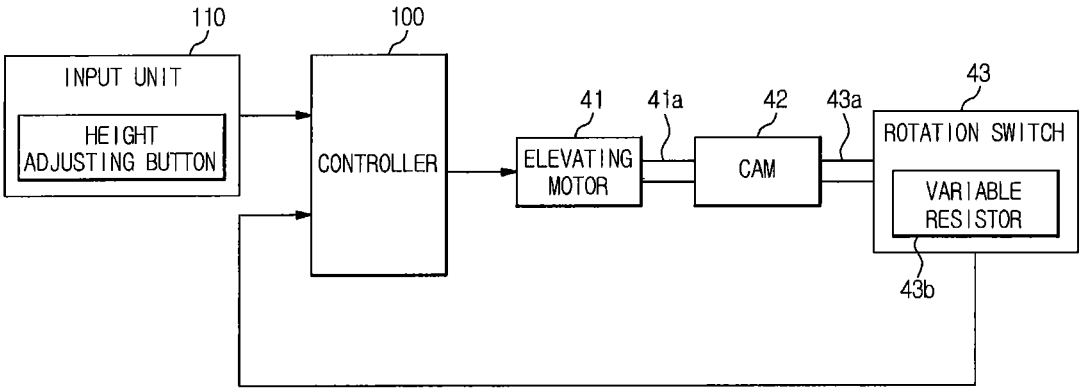
FIG. 6 is a block diagram of the cleaning apparatus, according to an example embodiment.

The cleaning apparatus, as shown in FIG. 6, includes a controller 100 to control overall operation of the cleaning apparatus, and an input unit 110 including the above-described height adjusting button to allow the user to input a desired operation, among various operations. The above-described elevating motor 41 is controlled by the controller 100 to generate rotation force in a given direction so as to rotate the cam 42, the connecting shaft 43*a*, and the variable resistor 43*b* connected to the connecting shaft 43*a*.

Figure 7:
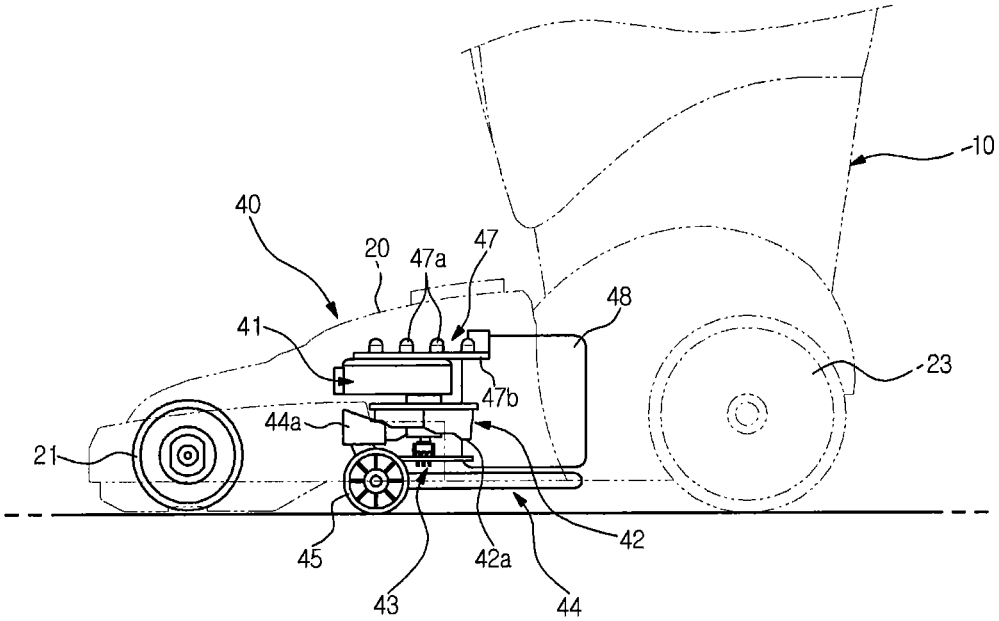
FIGS. 7 and 8 are schematic views showing operation of the elevating device of the cleaning apparatus, according to an example embodiment.
Figure 8:
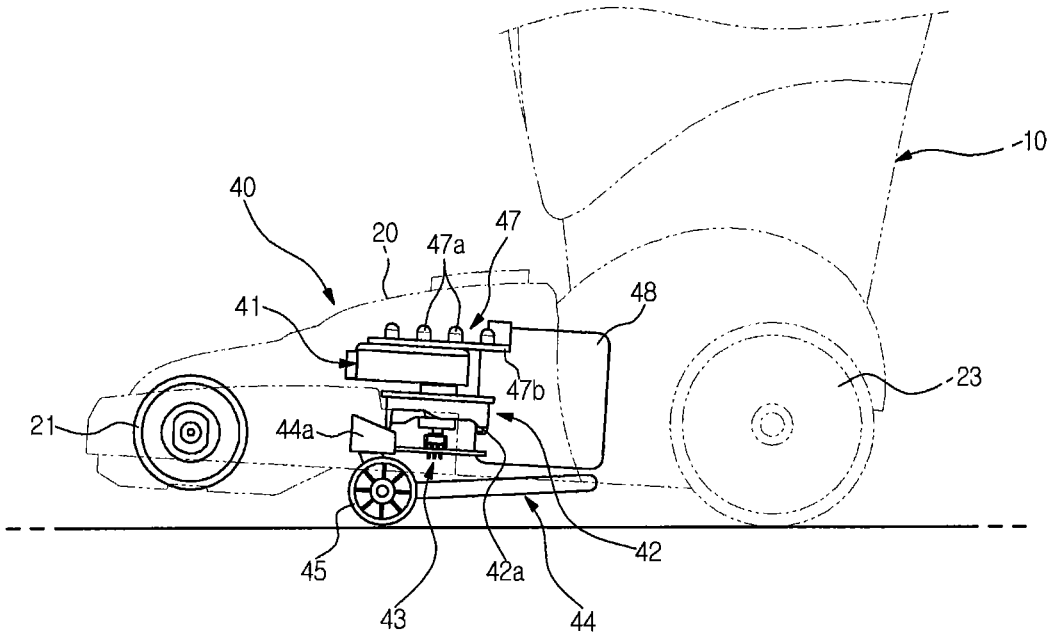

Next, operation of the cleaning apparatus having the above-described configuration will be described in detail First, as shown in FIG. 7, in case of cleaning a carpet, it is necessary to vary the height of the brush 21 that is usually located close to the floor. To this end, the user may attempt to vary the height of the brush 21 by pushing the height adjusting button provided at the handle 30. The controller 100 drives the elevating motor 41 to rotate the cam 42 in response to a height adjustment instruction input via the height adjusting button. Through rotation of the cam 42, the cam 42 acts to press the guide piece 44*a* of the elevating guide 44 downward via the cam surface 42*a*. Since the elevating guide 44 is supported on the floor via the auxiliary wheels 45 as described above, and therefore is not movable downward, the cam 42 is moved upward by reaction, as shown in FIG. 8, and simultaneously the elevating motor 41 is moved upward along with the cam 42. Thereby, the elevating motor 41, which is fixedly mounted, via the fixing bracket 46, within the suction unit 20 at the front end thereof, causes the front end of the suction unit 20 to rotate about the wheels 23 mounted to the rear end of the suction unit 20, and consequently the elevating guide 44 to rotate about the rear end thereof. In this way, as the front end of the suction unit 20 is moved upward, the brush 21 mounted in the suction unit 20 at the front end thereof is also moved upward. That is, the height of the brush 21 varies.

As described above, the connecting shaft 43*a* of the rotation switch 43 is connected to the cam 42, such that the variable resistor 43*b* rotates along with the cam 42 upon receiving rotation force transmitted through the connecting shaft 43*a* during rotation of the cam 42. Through rotation of the variable resistor 43*b*, output voltage of the variable resistor 43*b* varies stepwise to thereby be transmitted to the controller 100. The controller 100 drives the elevating motor 41 until the output voltage of the variable resistor 43*b* coincides with a preset voltage of the controller 100 corresponding to each height of the brush 21. When the output voltage of the variable resistor 43*b* coincides with the preset voltage of the controller 100, the controller 100 stops driving of the elevating motor 41. In this way, the brush 21 is located at a height that the user selects via the height adjusting button.

In the present embodiment, the elevating device 40 may vertically move the brush 21 placed at the front end of the suction unit 20 by allowing the suction unit 20 to rotate about the wheels 23 placed at the rear end thereof, but the disclosure is not limited thereto, and the brush 21 may be vertically moved in various ways.

As is apparent from the above description, according to the embodiment of the present invention, a cleaning apparatus may be structurally simple as a result of using an AC motor, which rotates in a given direction, as an elevating motor.

Although the embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A cleaning apparatus comprising:

a brush to sweep up dust on a floor via rotation thereof; and an elevating device to vertically adjust a height of the brush, wherein the elevating device comprises an elevating motor in the form of an Alternating Current (AC) motor to generate rotation force in a given direction, a cam configured to be rotated by the elevating motor and to vertically move the brush, and a rotation switch configured to be rotated by the cam and to sense a position of the brush, and wherein the rotation switch includes a connecting shaft connected to the cam, and a variable resistor configured to be rotated by the connecting shaft to vary output voltage based on a rotation angle thereof.

2. The cleaning apparatus according to claim 1, wherein the variable resistor has a circular annular shape to perform endless rotation in a given direction.

3. The cleaning apparatus according to claim 1, wherein the variable resistor has a resistance that varies stepwise based on the rotation angle of the rotation switch.

4. The cleaning apparatus according to claim 1, wherein the cam has a cam surface that circumferentially extends, a height of the circumferential extension circumferentially varies stepwise.

5. The cleaning apparatus according to claim 4, wherein the stepwise height of the cam surface is repeated at least twice when the cam rotates once.

6. The cleaning apparatus according to claim 5, wherein the cam surface sequentially raises the height of the brush from a first stage to a fourth stage.

7. The cleaning apparatus according to claim 6, wherein each stage of the first stage through fourth stage corresponds to a range of the rotation angle.

8. The cleaning apparatus according to claim 1, further comprising a display unit to display the height of the brush.

9. The cleaning apparatus according to claim 8, wherein the display unit includes a plurality of light emitting diodes, and a display substrate on which the plurality of light emitting diodes is placed.

10. The cleaning apparatus according to claim 1, wherein the rotation angle is sensed based on the output voltage, and the height of the brush is confirmed based on the rotation angle of the cam.

11. A cleaning apparatus comprising:

an upright main body;

a suction unit placed at a lower end of the main body and provided at a front end thereof with a brush;

a pair of wheels mounted on opposite sides of a rear end of the suction unit;

a pair of auxiliary wheels mounted on opposite sides of a bottom of the suction unit; and an elevating device mounted to the suction unit to vertically adjust a height of the brush, wherein the elevating device includes an elevating motor in the form of an AC motor to generate rotation force in a given direction, a cam configured to be rotated by the elevating motor and to vertically move the brush, and a rotation switch configured to be rotated by the cam and to sense the height of the brush, and wherein the rotation switch includes a variable resistor, and wherein the variable resistor has a circular annular shape, a resistance of which varied stepwise in a circumferential direction.

12. The cleaning apparatus according to claim 11, wherein the elevating device further includes an elevating guide having a rear end rotatably mounted on the bottom surface of the suction unit and a front end to which the auxiliary wheels are mounted, and wherein the elevating guide is supported by a cam surface of the cam to interact with the cam so as to allow the suction unit to rotate about the wheels.

13. The cleaning apparatus according to claim 11, wherein the rotation switch includes a connecting shaft connected to the cam, and a variable resistor configured to be rotated by the connecting shaft.

14. The cleaning apparatus according to claim 11, wherein the rotation angle is sensed based on the output voltage, and the height of the brush is confirmed based on the rotation angle of the cam.

15. The cleaning apparatus according to claim 10, wherein the elevating motor is fixedly mounted within the suction unit via a fixing bracket.

* * * * *